US009466455B2

(12) United States Patent
Hubbard

(10) Patent No.: US 9,466,455 B2
(45) Date of Patent: Oct. 11, 2016

(54) ELECTRON EMITTERS FOR X-RAY TUBES

(75) Inventor: Jesse Knight Hubbard, Riverton, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 740 days.

(21) Appl. No.: 13/162,300

(22) Filed: Jun. 16, 2011

(65) Prior Publication Data

US 2012/0321048 A1 Dec. 20, 2012

(51) Int. Cl.
*H01J 35/06* (2006.01)

(52) U.S. Cl.
CPC ..... *H01J 35/06* (2013.01); *H01J 2235/068* (2013.01)

(58) Field of Classification Search
CPC .. H01J 35/06; H01J 35/065; H01J 2235/068; H01J 2235/06; H01J 2235/062; H01J 35/04; H01J 35/02
See application file for complete search history.

(56) References Cited

U.S. PATENT DOCUMENTS

| | | | | |
|---|---|---|---|---|
| 4,679,219 | A | 7/1987 | Ozaki | |
| 5,146,481 | A | 9/1992 | Garg et al. | |
| 5,198,720 | A * | 3/1993 | Choi | 313/446 |
| 6,259,193 | B1 * | 7/2001 | Lipkin et al. | 313/341 |
| 7,785,113 | B2 * | 8/2010 | Mizoguchi | 439/67 |
| 2002/0168050 | A1 | 11/2002 | Ochiai et al. | |
| 2005/0082984 | A1 * | 4/2005 | Wada et al. | 313/623 |
| 2010/0195797 | A1 * | 8/2010 | Hauttmann | H01J 35/06 378/136 |
| 2010/0284519 | A1 * | 11/2010 | Moore et al. | 378/136 |
| 2010/0316192 | A1 * | 12/2010 | Hauttmann et al. | 378/136 |
| 2011/0117786 | A1 * | 5/2011 | Takata | 439/628 |

FOREIGN PATENT DOCUMENTS

| | | | |
|---|---|---|---|
| EP | 0164665 | A1 | 12/1985 |
| JP | 57013658 | A | 1/1982 |
| JP | H03-071554 | A | 3/1991 |
| JP | 2000-11854 | | 1/2000 |
| JP | 4059522 | | 3/2008 |

OTHER PUBLICATIONS

International Search Report and Written Opinion of the International Search Report dated Nov. 28, 2012 as received in related International Patent Application No. PCT/US2012/037537.
Supplementary European Search Report mailed Oct. 9, 2014 in related European Patent Application No. 12800939.6.

* cited by examiner

*Primary Examiner* — Hoon Song
(74) *Attorney, Agent, or Firm* — Maschoff Brennan

(57) ABSTRACT

Electron emitters for x-ray tubes. In one example embodiment, an electron emitter for an x-ray tube includes an electron filament and a plurality of electrical leads. The electron filament defines a plurality of openings. Each lead is positioned so as to extend through one of the openings and each lead is mechanically and electrically connected to the filament proximate the opening without the presence of braze material.

12 Claims, 9 Drawing Sheets

ELECTRON EMITTERS FOR X-RAY TUBES

BACKGROUND

X-ray tubes are extremely valuable tools that are used in a wide variety of applications, both industrial and medical. An x-ray tube typically includes a cathode and an anode positioned within an evacuated enclosure. The cathode includes an electron emitter and the anode includes a target surface that is oriented to receive electrons emitted by the electron emitter. During operation of the x-ray tube, an electric current is applied to the electron emitter, which causes electrons to be produced by thermionic emission. The electrons are then accelerated toward the target surface of the anode by applying a high-voltage potential between the cathode and the anode. When the electrons strike the anode target surface, the kinetic energy of the electrons causes the production of x-rays. The x-rays are produced in an omni-directional fashion where the useful portion ultimately exits the x-ray tube through a window in the x-ray tube, and interacts with a material sample, patient, or other object with the remainder being absorbed by other structures including those whose specific purpose is absorption of x-rays with non-useful trajectories or energies.

During the manufacture of a typical x-ray tube, the assembly of the electron emitter can be problematic. An electron emitter is typically formed from very fragile x-ray tube components which can be easily damaged during assembly. For example, brazing the electron emitter during assembly frequently results in damage to the electron emitter leading to immediate or eventual failure, thus shortening the operational life of the x-ray tube.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to electron emitters for x-ray tubes. Among other things, the example electron emitters disclosed herein are configured to reduce, if not eliminate, damage to the electron emitters during assembly. The example electron emitters disclosed herein thus result in the extension of the operational life of the x-ray tubes into which the example electron emitters are assembled.

In one example embodiment, an electron emitter for an x-ray tube includes an electron filament and a plurality of electrical leads. The electron filament defines a plurality of openings. Each lead is positioned so as to extend through one of the openings and each lead is mechanically and electrically connected to the filament proximate the opening without the presence of braze material.

In another example embodiment, an electron emitter for an x-ray tube includes an electron filament and a plurality of electrical leads. The electron filament defines a plurality of flanges. Each lead is connected to one of the flanges via a resistance weld without the presence of braze material.

In yet another example embodiment, an x-ray tube includes an evacuated enclosure, an anode at least partially positioned within the evacuated enclosure, and a cathode at least partially positioned within the evacuated enclosure. The cathode includes an electron emitter. The electron emitter includes an electron filament and a plurality of electrical leads. Each lead is mechanically and electrically connected to the filament without the presence of braze material.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to electron emitters for x-ray tubes. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example X-Ray Tube

Figure 1A:
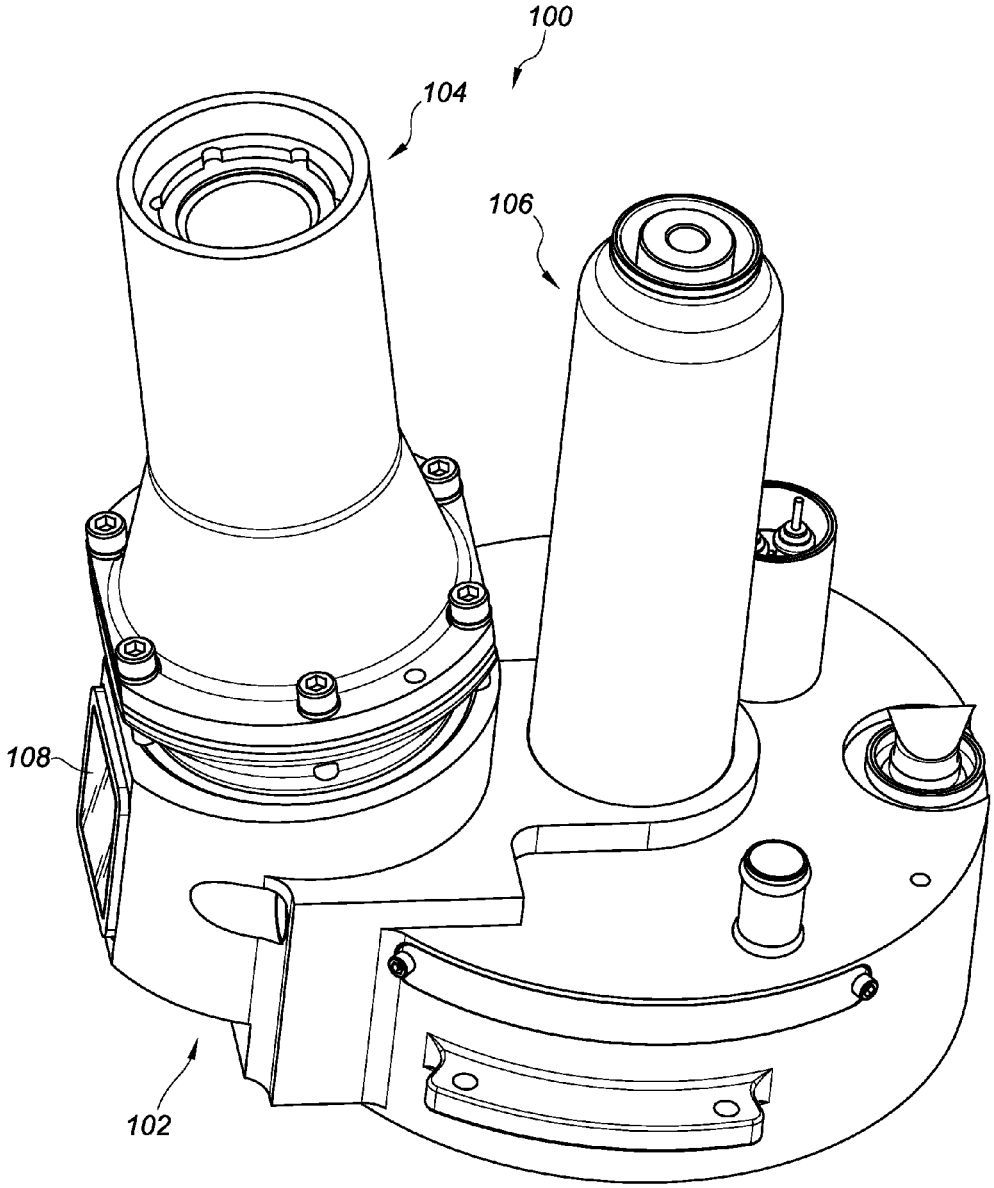
FIG. 1A is a perspective view of an example x-ray tube.
Figure 1B:
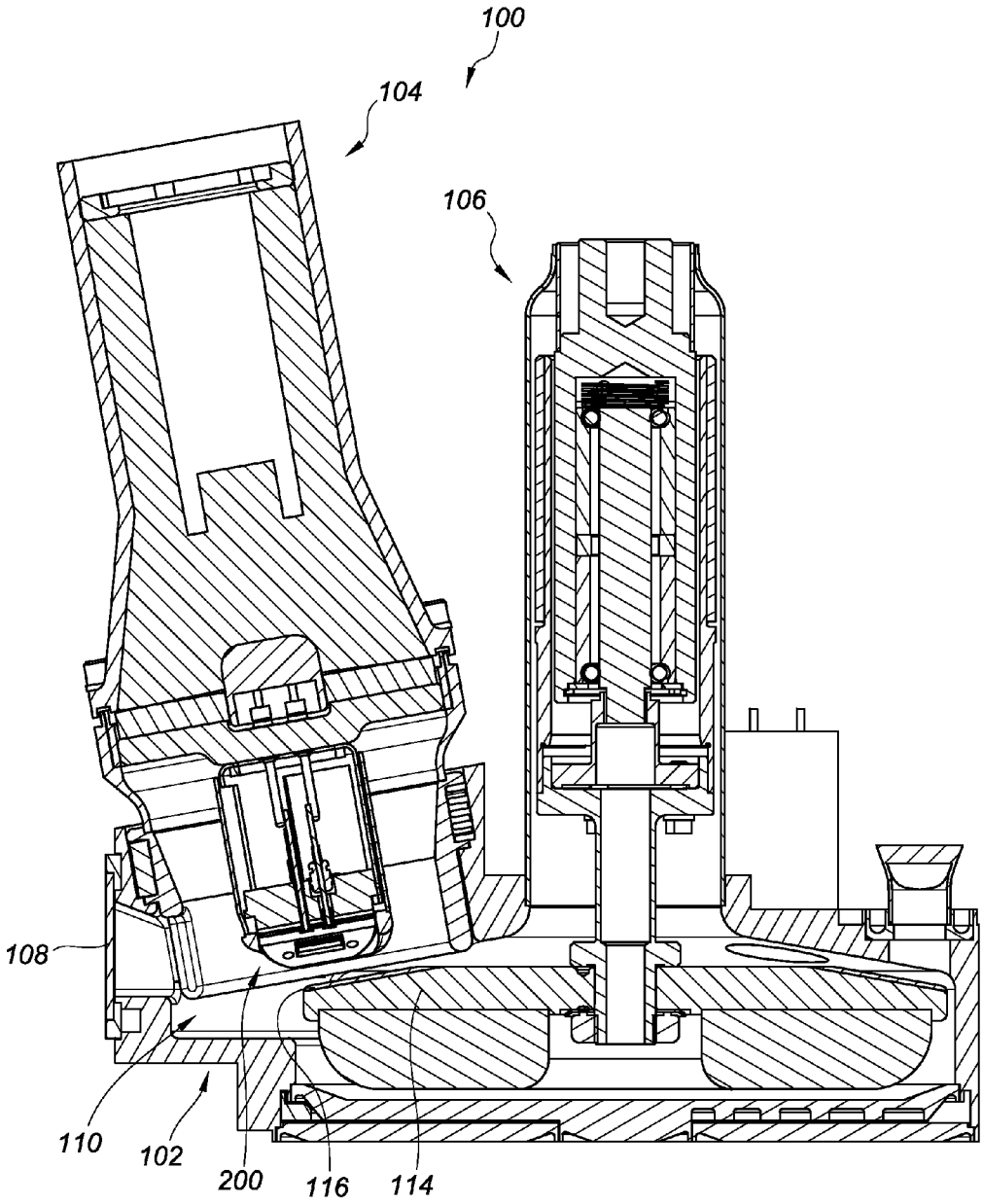
FIG. 1B is a cross-sectional side view of the example x-ray tube of FIG. 1A.
Figure 2A:
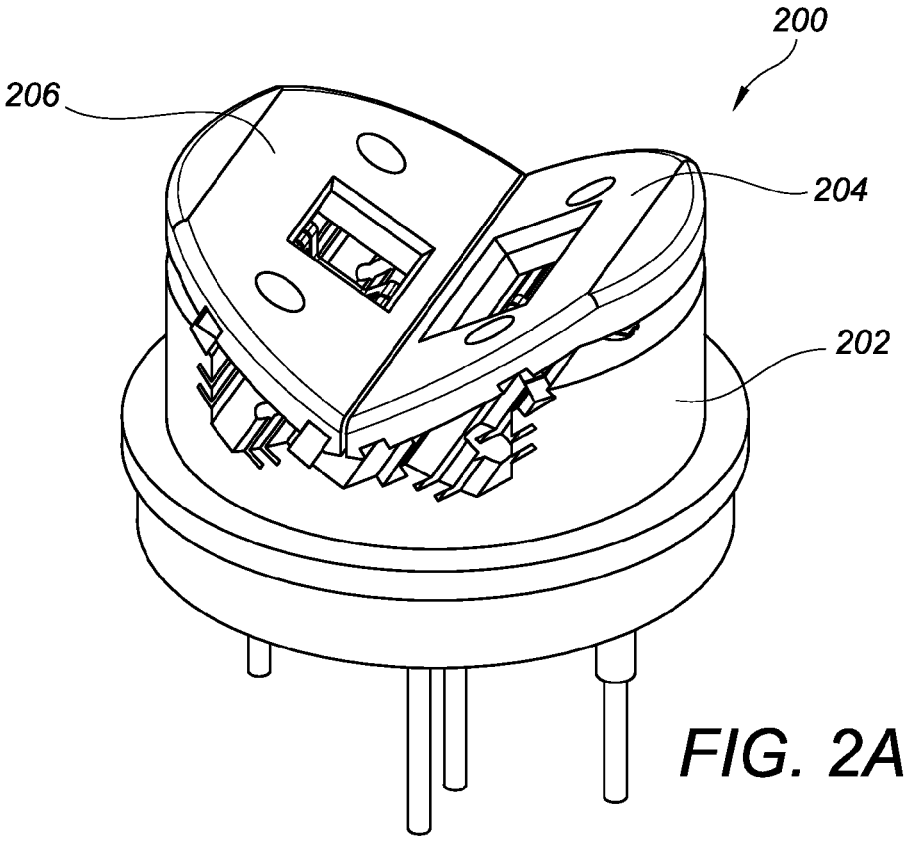
FIG. 2A is a perspective view of an example cathode of the example x-ray tube of FIG. 1A.
Figure 2B:
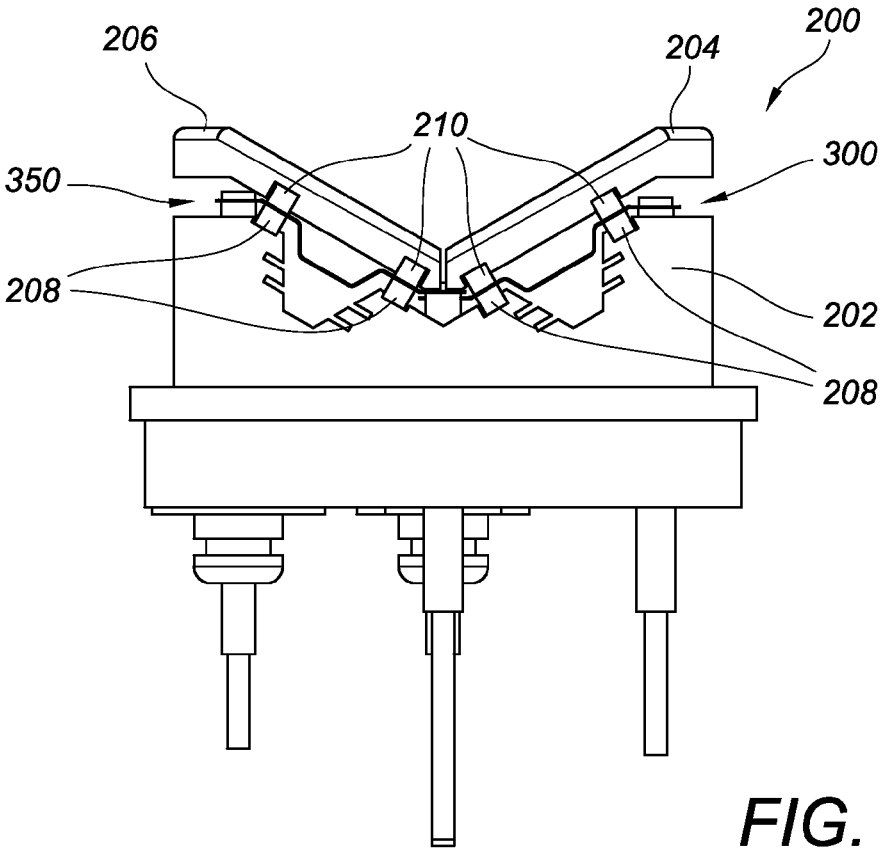
FIG. 2B is a side view of the example cathode of FIG. 2A.

With reference first to FIGS. 1A and 1B, an example x-ray tube 100 is disclosed. The example x-ray tube 100 is configured for use in mammography applications, but it is understood that the example electron emitters disclosed herein can be employed in x-ray tubes configured for use in other applications including, but not limited to, computed tomography (CT), diagnostic, or industrial.

As disclosed in FIG. 1A, the example x-ray tube 100 generally includes a can 102, a high-voltage connector 104 removably attached to the can 102, a stator 106 attached to the can 102, and an x-ray tube window 108 attached to the can 102. The x-ray tube window 108 is comprised of an x-ray transmissive material, such as beryllium or other suitable material(s). The can 102 may be formed from stainless steel, such as 304 stainless steel.

As disclosed in FIG. 1B, the x-ray tube window 108 and the can 102 at least partially define an evacuated enclosure 110 within which a cathode 200 and a rotatable anode 114 are positioned. More particularly, the cathode 200 extends into the can 102 and the anode 114 is also positioned within the can 102. The anode 114 is spaced apart from and oppositely disposed to the cathode 200, and may be at least partially composed of a thermally conductive material such as tungsten or a molybdenum alloy for example. The anode 114 and cathode 200 are connected in an electrical circuit that allows for the application of a high voltage potential between the anode 114 and the cathode 200. The cathode 200 includes example electron emitters, as discussed below in connection with FIGS. 3A-3E, that are connected to an appropriate power source (not shown). The anode 114 is rotated by the stator 106.

With continued reference to FIG. 1B, prior to operation of the example x-ray tube 100, the evacuated enclosure 110 is evacuated to create a vacuum. Then, during operation of the example x-ray tube 100, an electrical current is passed through the example electron emitter of the cathode 200 to cause electrons to be emitted from the cathode 200 by thermionic emission. The application of a high voltage differential between the anode 114 and the cathode 200 then causes the electrons to accelerate from the cathode 200 and toward a rotating focal track 116 that is positioned on the rotating anode 114. The focal track 116 may be composed for example of tungsten or other material(s) having a high atomic ("high Z") number. As the electrons accelerate, they gain a substantial amount of kinetic energy, and upon striking the target material on the rotating focal track 116, some of this kinetic energy is converted into x-rays.

The focal track 116 is oriented so that many of the emitted x-rays are directed toward the x-ray tube window 108. As the x-ray tube window 108 is comprised of an x-ray transmissive material, the x-rays emitted from the focal track 116 pass through the x-ray tube window 108 in order to strike an intended target (not shown) to produce an x-ray image (not shown). The window 108 therefore hermetically seals the vacuum of the evacuated enclosure 110 of the x-ray tube 100 from the atmospheric air pressure outside the x-ray tube 100 and yet enables the x-rays generated by the rotating anode 114 to exit the x-ray tube 100.

Although the example x-ray tube 100 is depicted as a rotatable anode x-ray tube, example embodiments disclosed herein may be employed in other types of x-ray tubes. Thus, the example electron emitters disclosed herein may alternatively be employed, for example, in a stationary anode x-ray tube.

2. Example Cathode

With reference now to FIGS. 2A-2D, additional aspects of the example cathode 200 are disclosed. As disclosed in FIGS. 2A and 2B, the example cathode 200 includes a cathode head 202, tabs 204 and 206, lower insulating rods 208, upper insulating rods 210, and example electron emitters 300 and 350. As disclosed in FIG. 2B, a portion of the example electron emitter 300 is sandwiched between the upper and lower insulating rods 210 and 208 by the tab 204 and the cathode head 202. Similarly, a portion of the example electron emitter 350 is sandwiched between the upper and lower insulating rods 210 and 208 by the tab 206 and the cathode head 202. The tabs 204 and 206 function to both secure the example electron emitters 300 and 350 and shape and direct the electron beams generated by the example electron emitters 300 and 350, respectively, toward the rotating focal track 116 that is positioned on the rotating anode 114 (see FIG. 1B). The tabs 204 and 206 may be attached to the cathode head 202 using screws or other fasteners or a weld, for example.

3. Example Electron Emitters

With reference now to FIGS. 3A-3G, additional aspects of the example electron emitters 300 and 350 are disclosed. As disclosed in FIG. 3A, the example electron emitter 300 includes an electron filament 302, a pair of electrical leads 304, and a pair of sleeves 306. Similarly, the example electron emitter 350 includes an electron filament 352, a pair of electrical leads 354, and a pair of sleeves 356. The electrical leads 354 and the sleeves 356 are identical to the electrical leads 304 and the sleeves 306, respectively. The filaments 302 and 352 can be formed from tungsten foil, for example, in order to emit electrons when an electrical current passes through the filaments 302 and 352.

Figure 3A:
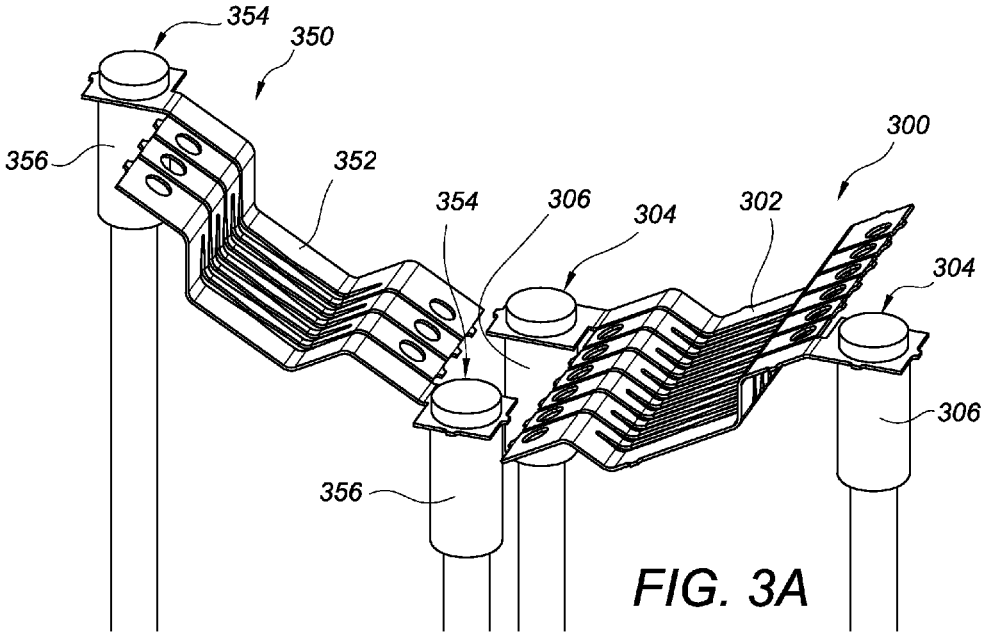
FIG. 3A is a perspective view of example electron emitters of the example cathode of FIG. 2A.
Figure 3B:
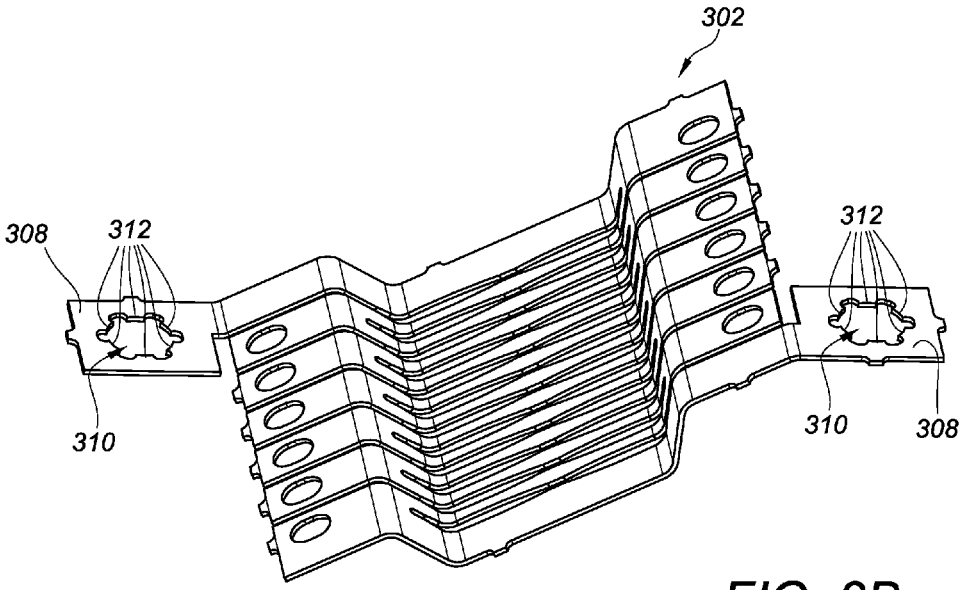
FIG. 3B is a perspective view of a filament of one of the example electron emitters of FIG. 3A.

As disclosed in FIG. 3B, the electron filament 302 of the example electron emitter 300 defines flanges 308 that each defines and opening 310. Each flange 308 further defines a plurality of internal teeth 312 around the opening 310. As disclosed in FIG. 3C, each of the electrical leads 304 includes a substantially cylindrical portion 314 and a substantially flat head portion 316 that is connected to the substantially cylindrical portion 314.

Figure 3C:
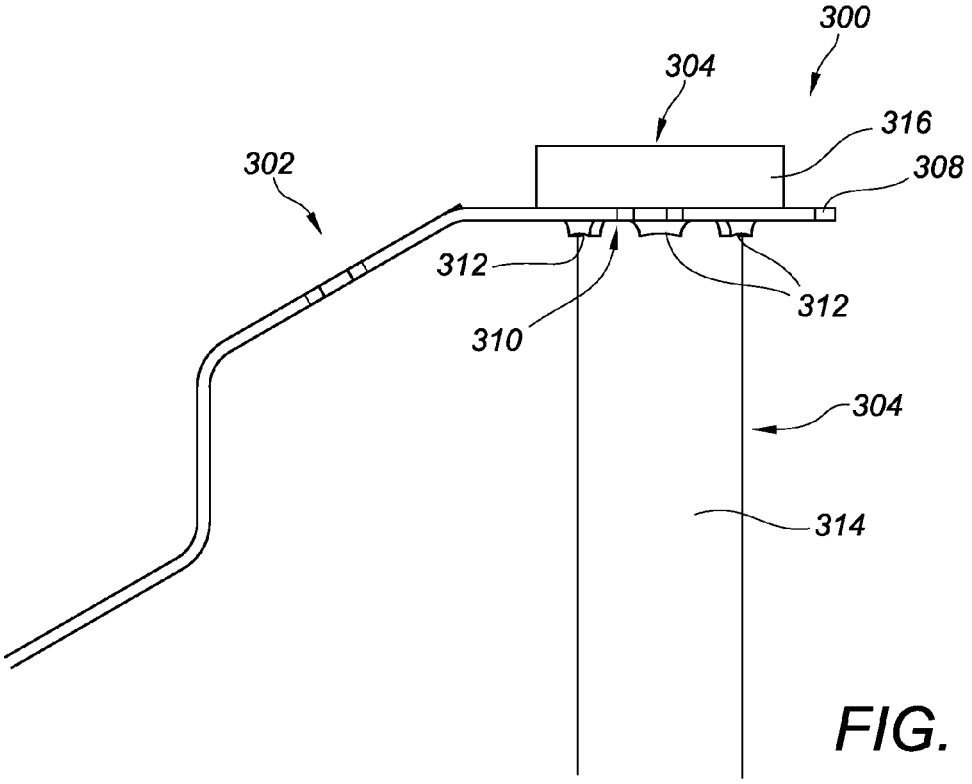
FIG. 3C is a side view of a portion of the example filament of FIG. 3B connected to an example lead.

As disclosed in FIG. 3C, during assembly of the example electron emitter 300, the lead 304 is pushed through the opening 310 from above so that the substantially cylindrical portion 314 is positioned so as to extend through the opening 310 and the substantially flat head portion 316 is positioned parallel to and abutting the flange 308 of the filament 302. Once so positioned, the teeth 312 positioned around the opening 310 are biased against the substantially cylindrical portion 314 of the lead 304 so that the lead 304 is mechanically and electrically connected to the filament 302 proximate the opening 310 without the presence of braze material.

Figure 3D:
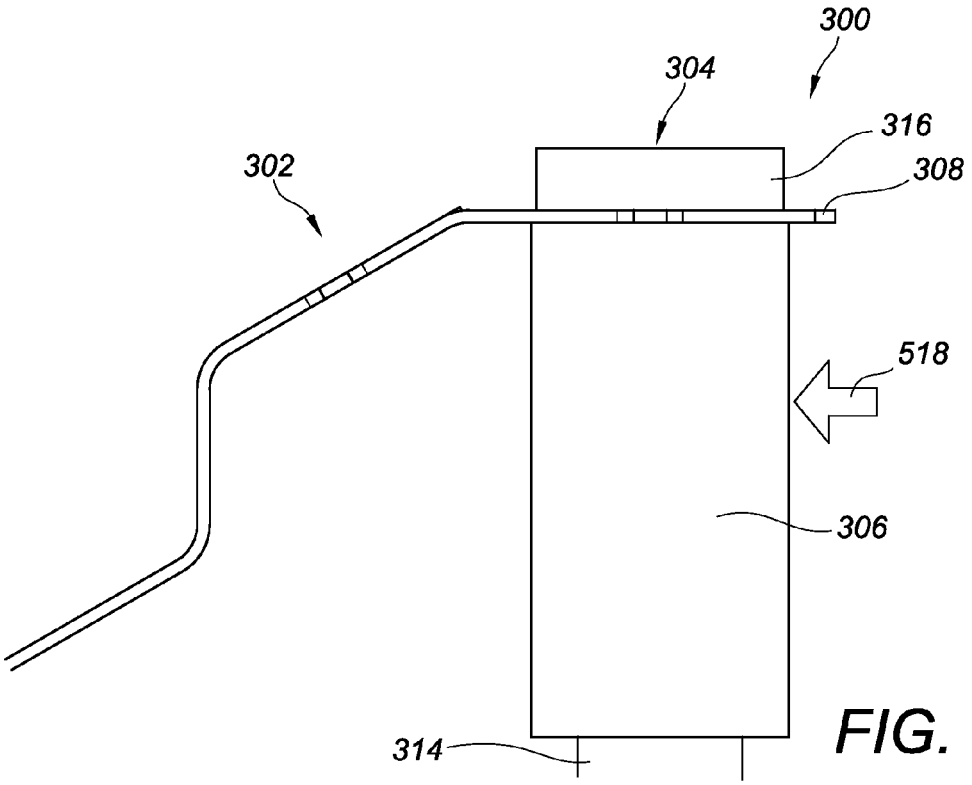
FIG. 3D is a side view of the connected example filament and example lead of FIG. 3C also connected to an example sleeve.

Next, as disclosed in FIG. 3D, the sleeve 306 can be slid up along the substantially cylindrical portion 314 of the lead 304 in order to sandwich the flange 308 of the filament 302 between the substantially flat head portion 316 and the sleeve 306. The sleeve 306 may then be attached to the substantially cylindrical portion 314 of the lead 304 at 518 using laser welding or crimping, for example.

Figure 3E:
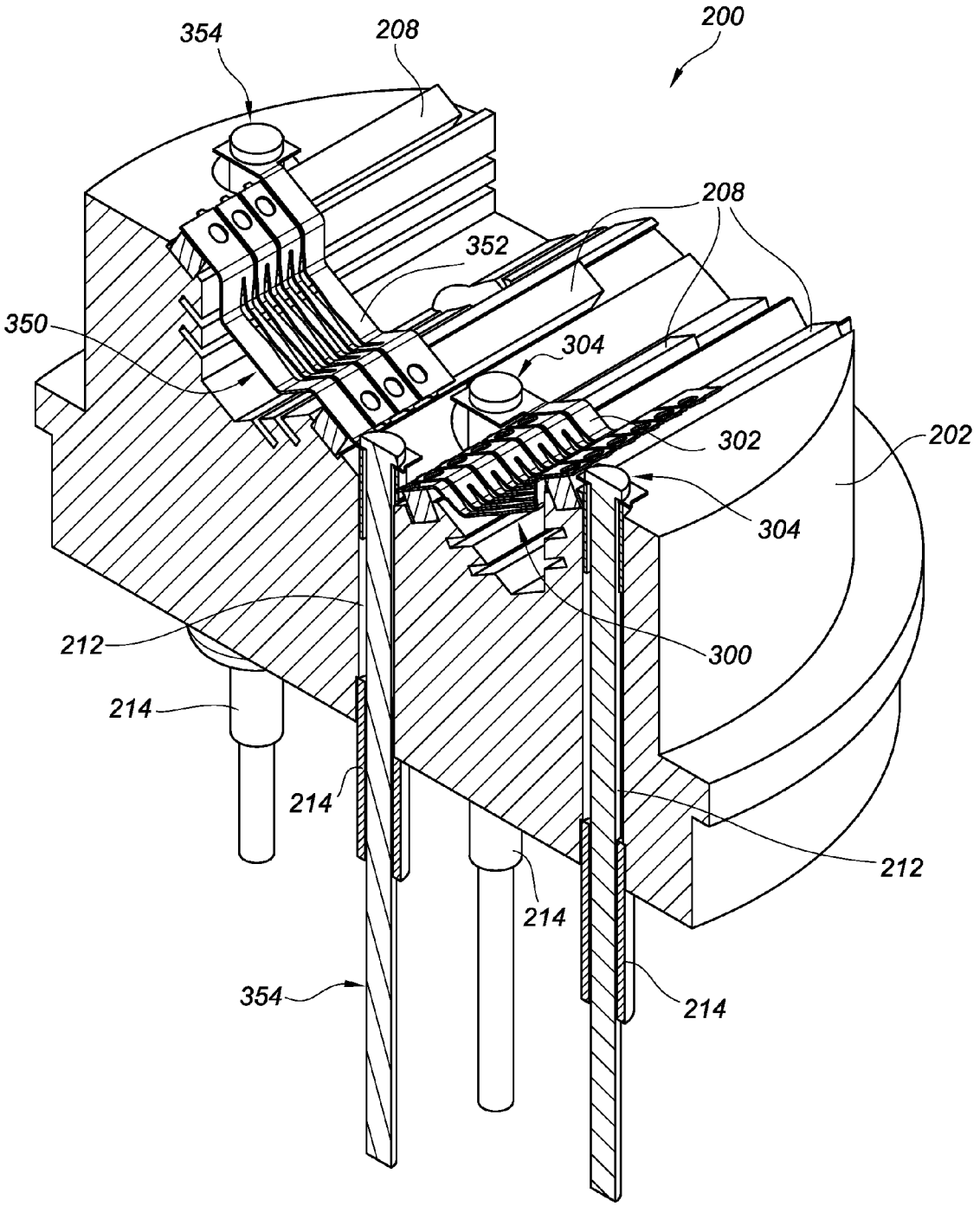
FIG. 3E is a cross-sectional perspective view of a portion of the example cathode of FIG. 2A.
Figure 3F:
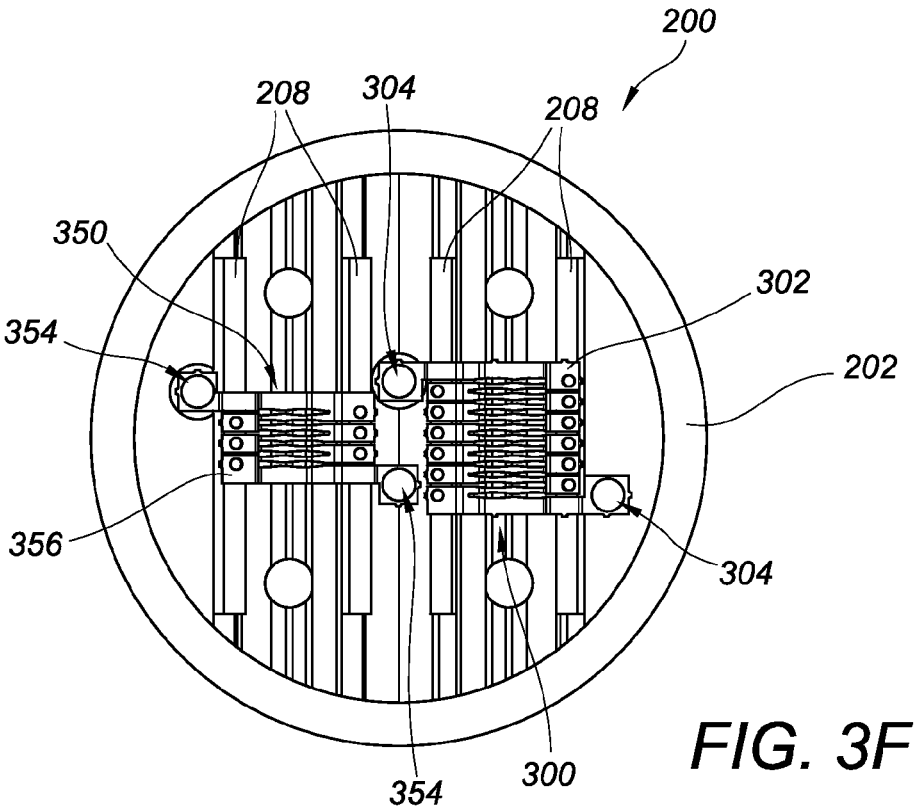
FIG. 3F is a top view of a portion of the example cathode of FIG. 2A.
Figure 3G:
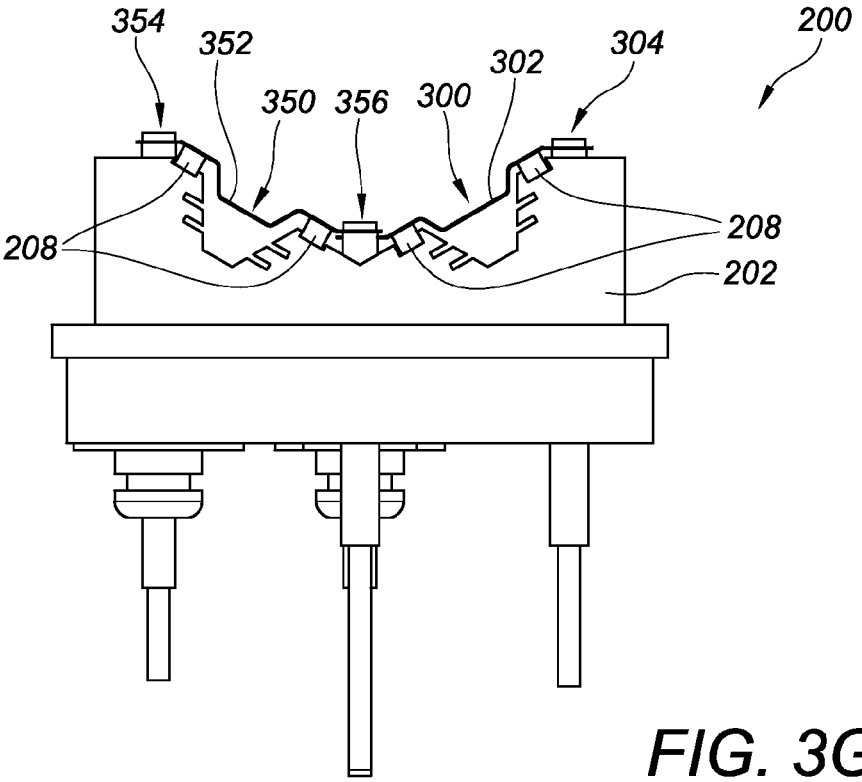
FIG. 3G is a side view of a portion of the example cathode of FIG. 2A.

Next, as disclosed in FIGS. 3E, 3F, and 3G, the lower insulating rods 208 may be positioned on the cathode head 202 and the filaments 302 and 352 of the example electron emitters 300 and 350 can be positioned on the lower insulating rods 208 by inserting the leads 304 and 354 through openings 212 defined in the cathode head 202 (only two of the four openings 212 are shown in FIG. 3E). Also, insulating sleeves 214 may further be slid up along the leads 304 and 354 to insulate the leads 304 and 354 from the cathode head 202. Finally, as disclosed in FIGS. 2A and 2B, the upper insulating rods 210 can be placed on the filaments 302 and 352 and the tabs 204 and 206 can be attached to the cathode head 202 in order to complete the assembly of the example cathode 200.

As noted above, the leads 304 and 354 are mechanically and electrically connected to the filaments 302 and 352, respectively, without brazing. These mechanical and electrical connections are thus accomplished without the damages that often results to these fragile components during a brazing process. Thus, the electron emitters 300 and 350 are configured to reduce, if not eliminate, damage to the electron emitters 300 and 350 during assembly, thus resulting in the extension of the operational life of the x-ray tube 100 (see FIGS. 1A and 1B) into which electron emitters 300 and 350 are assembled.

4. Another Example Electron Emitter

Figure 4:
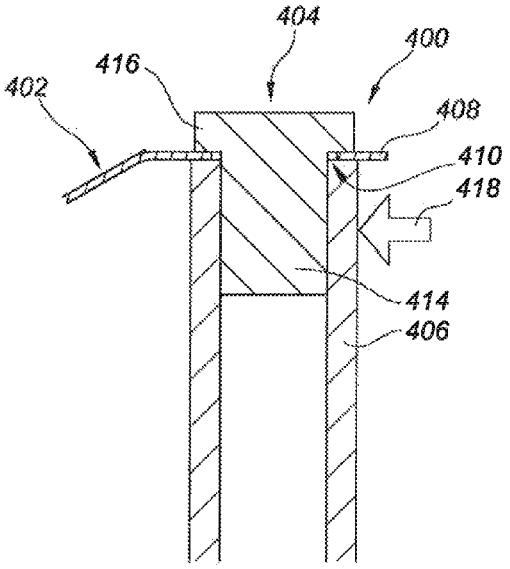
FIG. 4 is a cross-sectional side view of a portion of another example electron emitter.

With reference now to FIG. 4, aspects of another example electron emitter 400 are disclosed. As disclosed in FIG. 4, the example electron emitter 400 includes an electron filament 402, a pair of electrical leads 404 (only one of which is shown in FIG. 4), and a pair of sleeves 406 (only one of which is shown in FIG. 4). As disclosed in FIG. 4, the electron filament 402 of the example electron emitter 400 defines flanges 408 (only one of which is shown in FIG. 4) that each defines an opening 410.

As disclosed in FIG. 4, the electrical lead 404 includes a substantially cylindrical portion 414 and a substantially flat head portion 416 that is connected to the substantially cylindrical portion 414. However, unlike the substantially cylindrical portion 314 of the lead 304 discussed above, the substantially cylindrical portion 414 of the lead 404 is shorter than the sleeve 406. Thus, the sleeve 406 functions as a hollow electrical lead to provide electricity to the filament 402.

During assembly, the sleeve 406 can be slid up along the substantially cylindrical portion 414 of the lead 404 in order to abut the flange 408 of the filament 402 and sandwich the flange 408 between the substantially flat head portion 416 and the sleeve 406. The sleeve 406 may then be attached to the substantially cylindrical portion 414 of the lead 404 at 418 using laser welding or crimping, for example.

Thus, each lead 404 is mechanically and electrically connected to the filament 402 proximate one of the openings 410 without brazing, thereby avoiding the damage that often results to these fragile components during a brazing process.

5. Another Example Electron Emitter

Figure 5:
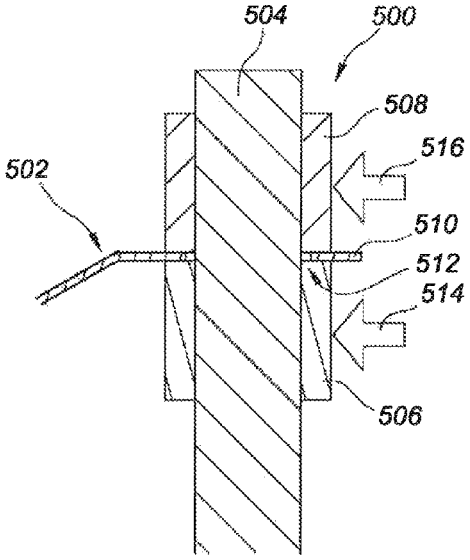
FIG. 5 is a cross-sectional side view of a portion of another example electron emitter.

With reference now to FIG. 5, aspects of another example electron emitter 500 are disclosed. As disclosed in FIG. 5, the example electron emitter 500 includes an electron filament 502, a pair of electrical leads 504 (only one of which is shown in FIG. 5), a pair of sleeves 506 (only one of which is shown in FIG. 5), and a pair of sleeves 508 (only one of which is shown in FIG. 5). As disclosed in FIG. 5, the electron filament 502 of the example electron emitter 500 defines flanges 510 (only one of which is shown in FIG. 5) that each defines an opening 512.

As disclosed in FIG. 5, the electrical lead 504 is substantially cylindrical and does not include a substantially flat head portion. During assembly, the sleeve 506 can be slid up along the substantially cylindrical lead 504 and attached at 514 in order to abut the flange 510 of the filament 502 from below. Similarly, the sleeve 508 can be slid down along the substantially cylindrical lead 504 at attached at 516 in order to abut the flange 510 of the filament 502 from above. Thus, the sleeves 506 and 508 can cooperate to sandwich the flange 510 of the filament 502 between the sleeves 506 and 508.

Thus, each lead 504 is mechanically and electrically connected to the filament 502 proximate one of the openings 512 without brazing, thereby avoiding the damage that often results to these fragile components during a brazing process.

6. Another Example Electron Emitter

Figure 6A:
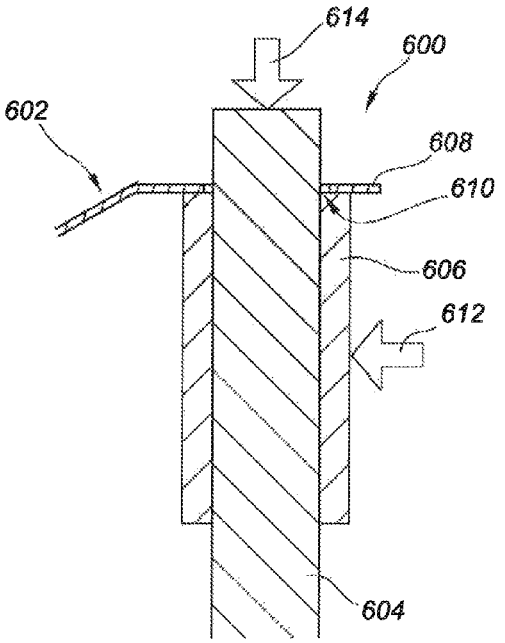
FIGS. 6A and 6B are cross-sectional side views of a portion of another example electron emitter.
Figure 6B:
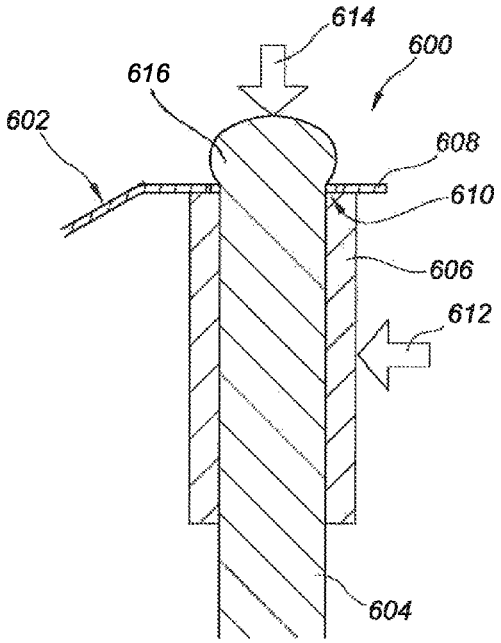

With reference now to FIGS. 6A and 6B, aspects of another example electron emitter 600 are disclosed. As disclosed in FIG. 6A, the example electron emitter 600 includes an electron filament 602, a pair of electrical leads 604 (only one of which is shown in FIG. 6), and a pair of sleeves 606 (only one of which is shown in FIG. 6). The electron filament 602 of the example electron emitter 600 defines flanges 608 (only one of which is shown in FIG. 6) that each defines an opening 610.

As disclosed in FIG. 6A, the electrical lead 604 is substantially cylindrical and does not include a substantially flat head portion. During assembly, the sleeve 606 can be slid up along the substantially cylindrical lead 604 and attached at 612 in order to abut the flange 608 of the filament 602 from below. Then, as disclosed in FIGS. 6A and 6B, the lead 604 can be deformed at 614, using a laser weld for example, to sandwich the flange 608 of the filament 602 between the sleeves 606 and an enlarged portion 616 of the lead 604.

Thus, each lead 604 is mechanically and electrically connected to the filament 602 proximate the openings 610 without brazing, thereby avoiding the damage that often results to these fragile components during a brazing process.

7. Other Example Electron Emitters

With reference now to FIGS. 7A, 7B, 8A, 8B, aspects of other example electron emitters 700, 700', 800, and 800' are disclosed, respectively.

Figure 7A:
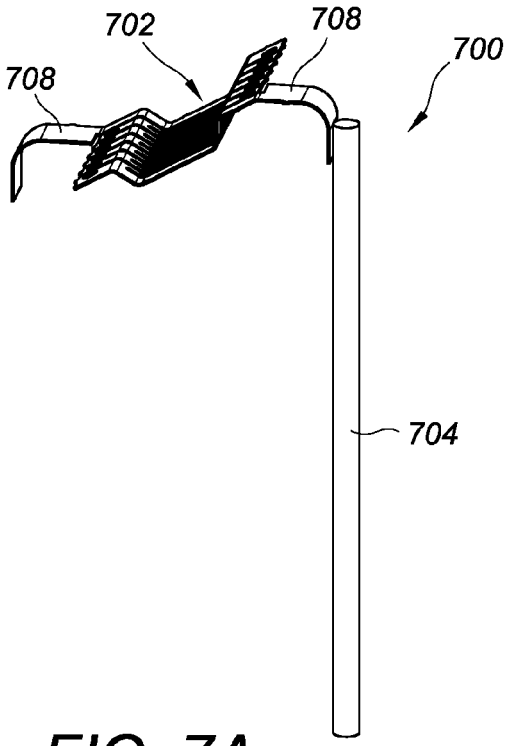
FIG. 7A is a perspective view of a portion of another example electron emitter.
Figure 7B:
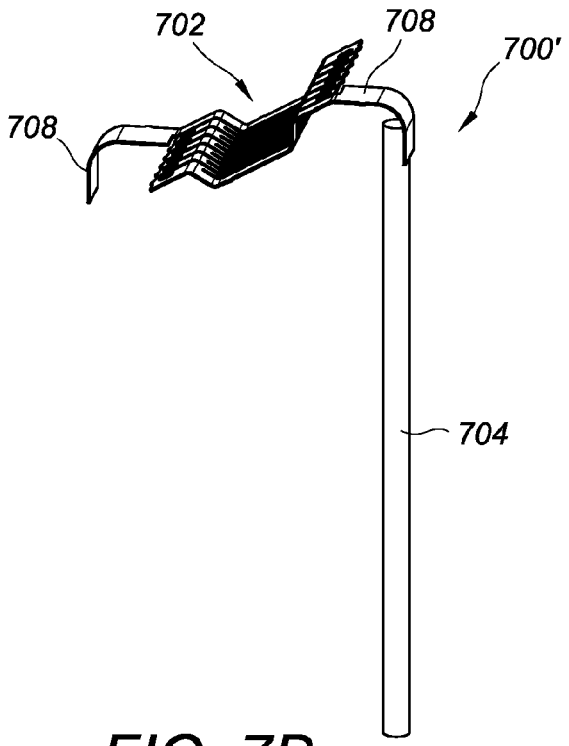
FIG. 7B is a perspective view of a portion of another example electron emitter.

As disclosed in FIGS. 7A and 7B, the example electron emitters 700 and 700' each includes an electron filament 702 and a pair of electrical leads 704 (only one of which is shown in FIG. 7A and FIG. 7B). The electron filament 702 of the example electron emitter 700 defines flanges 708.

Each of the leads 704 (only one of which is shown in each of FIG. 7A and FIG. 7B) is mechanically and electrically connected to one of the flanges 708, using a resistance weld for example. Each flange 708 is bent so that the portion of the flange to which the lead 704 is connected is substantially parallel to the lead 704. In the example electron emitter 700', the bent flange 708 is bent over a terminal end of the lead 704 to which the bent flange 704 is connected.

Thus, each lead 704 is mechanically and electrically connected to the filament 702 without brazing, thereby avoiding the damage that often results to these fragile components during a brazing process.

Figure 8A:
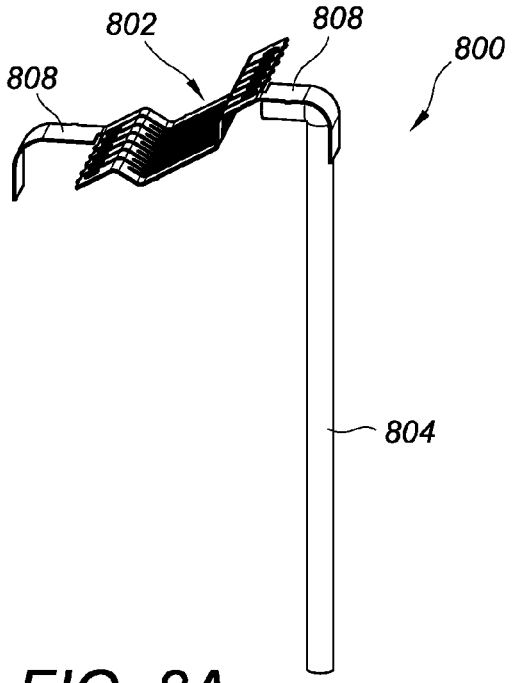
FIG. 8A is a perspective view of a portion of another example electron emitter.
Figure 8B:
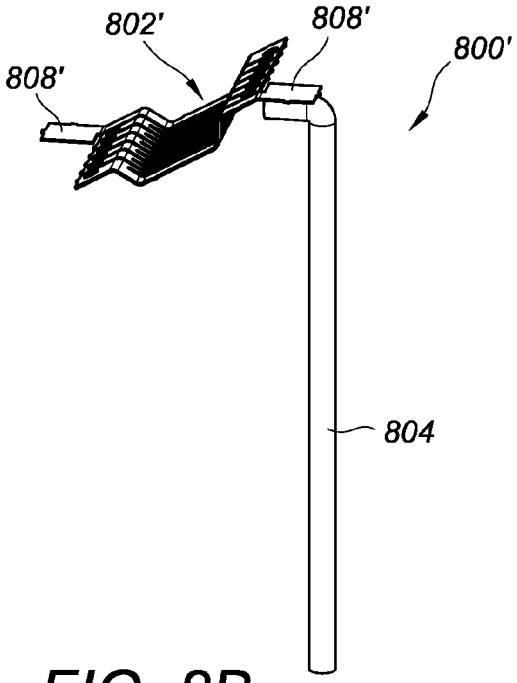
FIG. 8B is a perspective view of a portion of another example electron emitter.

As disclosed in FIGS. 8A and 8B, the example electron emitters 800 and 800' each includes an electron filament 802 and 802', respectively, and a pair of electrical leads 804 (only one of which is shown in each of FIG. 8A and FIG. 8B). The electron filament 802 of the example electron emitter 800 defines flanges 808 and the electron filament 802' of the example electron emitter 800' defines flanges 808'.

Each of the leads 804 (only one of which is shown in each of FIG. 8A and FIG. 8B) is mechanically and electrically connected to one of the flanges 808 or 808', using a resistance weld for example. Each lead 804 is bent so that the portion of the lead 804 to which the flange 808 or 808' is connected is substantially parallel to the flange 808 or 808'. Further, in the example electron emitter 800, the bent flange 808 is bent over the bent portion of the lead 804 to which the flange 808 is connected.

Thus, each lead 804 is mechanically and electrically connected to the filament 802 or 802' without brazing, thereby avoiding the damage that often results to these fragile components during a brazing process.

The example embodiments disclosed herein may be embodied in other specific forms. The example embodiments disclosed herein are therefore to be considered in all respects only as illustrative and not restrictive.

What is claimed is:

1. An electron emitter for an x-ray tube, the electron emitter comprising:

an electron filament that defines a plurality of openings;

a plurality of electrical leads, each lead being positioned so as to extend through one of the openings; and one or more sleeves that surround and is welded or crimped to at least one of the leads so as to abut the filament, wherein each lead is mechanically and electrically connected to the filament proximate the opening.

2. The electron emitter as recited in claim 1, wherein the electron filament further defines a plurality of internal teeth around each opening that are biased against the corresponding lead that is positioned so as to extend through the opening.

3. The electron emitter as recited in claim 1, wherein each lead is shorter than the sleeve that surrounds the lead.

4. The electron emitter as recited in claim 1, wherein the one or more sleeves comprises a pair of sleeves secured to at least one lead with each sleeve of the pair of sleeves abutting the filament.

5. An electron emitter for an x-ray tube, the electron emitter comprising:

an electron filament that defines a plurality of openings;

a plurality of electrical leads, each lead being positioned so as to extend through one of the openings; and one or more sleeves that surround and is secured to at least one of the leads so as to abut the filament, wherein each lead is mechanically and electrically connected to the filament proximate the opening and comprises:

a substantially cylindrical portion that is positioned so as to extend through the opening; and a substantially flat head portion that is connected to the substantially cylindrical portion and is positioned parallel to the portion of the filament through which the substantially cylindrical portion extends so as to abut the filament.

6. The electron emitter as recited in claim 5, wherein the filament further defines a plurality of internal teeth around each opening that are biased against the corresponding lead that is positioned so as to extend through the opening.

7. The electron emitter as recited in claim 5, wherein each lead is shorter than the sleeve that surrounds the lead.

8. An electron emitter for an x-ray tube, the electron emitter comprising:

an electron filament that defines a plurality of openings;

a plurality of electrical leads, each lead being positioned so as to extend through one of the openings; and one or more sleeves that surround and is secured to at least one of the leads so as to abut the filament, wherein each lead is mechanically and electrically connected to the filament proximate the opening and each lead includes an enlarged portion that abuts the portion of the filament through which the lead extends opposite the sleeve that surrounds the lead.

9. The electron emitter as recited in claim 8, wherein the filament further defines a plurality of internal teeth around each opening that are biased against the corresponding lead that is positioned so as to extend through the opening.

10. An x-ray tube comprising:

an evacuated enclosure;

an anode at least partially positioned within the evacuated enclosure;

a cathode at least partially positioned within the evacuated enclosure, the cathode including an electron emitter comprising:

an electron filament;

a plurality of electrical leads, wherein each lead comprises:

a substantially cylindrical portion that is positioned so as to extend through an opening defined by the electron filament;

an enlarged portion that is connected to the substantially cylindrical portion and abuts the portion of the filament through which the substantially cylindrical portion extends; and at least one sleeve that surrounds and is secured to the lead so as to abut the filament, each lead being mechanically and electrically connected to the filament without the presence of braze material.

11. The x-ray tube as recited in claim 10, wherein the electron filament further defines a plurality of internal teeth around each opening that are biased against the corresponding lead that is positioned so as to extend through the opening.

12. The electron emitter as recited in claim 8, wherein each lead is shorter than the sleeve that surrounds the lead.

* * * * *